US009423818B2

(12) United States Patent
Gibbons, Jr. et al.

(10) Patent No.: US 9,423,818 B2
(45) Date of Patent: Aug. 23, 2016

(54) OVER-CENTER HANDLE MECHANISM FOR INCREASED TACTILE FEEDBACK ON A ROTARY ACTUATOR

(71) Applicant: SCHNEIDER ELECTRIC USA, INC., Palatine, IL (US)

(72) Inventors: Donald G. Gibbons, Jr., Wake Forest, NC (US); Tony R. Robbins, Zebulon, NC (US); Stanley H. Edwards, Jr., Raleigh, NC (US)

(73) Assignee: SCHNEIDER ELECTRIC USA, INC., Schaumburg, IL (US)

( * ) Notice: Subject to any disclaimer, the term of this patent is extended or adjusted under 35 U.S.C. 154(b) by 36 days.

(21) Appl. No.: 14/608,925

(22) Filed: Jan. 29, 2015

(65) Prior Publication Data

US 2015/0221463 A1 Aug. 6, 2015

Related U.S. Application Data

(60) Provisional application No. 61/935,544, filed on Feb. 4, 2014.

(51) Int. Cl.

| | |
|---|---|
| ***H01H 21/40*** | (2006.01) |
| ***G05G 5/03*** | (2008.04) |
| ***G05G 1/10*** | (2006.01) |
| ***H01H 71/56*** | (2006.01) |

(52) U.S. Cl.

CPC .. *G05G 5/03* (2013.01); *G05G 1/10* (2013.01); *H01H 71/56* (2013.01); *Y10T 74/20474* (2015.01)

(58) Field of Classification Search

CPC ..... G05G 1/10; G05G 5/03; H01H 71/56; Y10T 74/20474

USPC ..... 200/331, 17 R, 43.04, 43.08, 43.11, 564, 200/565, 334, 336, 329–330, 50.12, 50.13, 200/50.15, 50.01, 50.07, 50.05; 74/504, 74/507, 527, 531, 575, 577 M

See application file for complete search history.

(56) References Cited

U.S. PATENT DOCUMENTS

| | | | | |
|---|---|---|---|---|
| 6,578,447 | B1 * | 6/2003 | Fraser | G05G 5/06 200/565 |
| 7,015,403 | B2 * | 3/2006 | Houck, III | H01H 71/04 200/50.05 |
| 7,071,427 | B2 * | 7/2006 | Houck, III | H01H 9/22 200/50.05 |
| 7,315,006 | B2 * | 1/2008 | Houck, III | H01H 3/50 200/331 |

* cited by examiner

*Primary Examiner* — Edwin A. Leon
(74) *Attorney, Agent, or Firm* — Locke Lord LLP

(57) ABSTRACT

An over-center handle mechanism is provided to operate electrical equipment, such as a switch or breaker, housed in an electrical enclosure. The over-center handle mechanism includes an adaptor knob, a rotary actuator and a spring. The adaptor knob interfaces with the electrical equipment. The rotary actuator is connected to the adaptor knob, and includes a cam. A through-door handle is used to operate the rotary actuator, which in turn operates the electrical equipment via the adaptor knob. To optimize an angular torque feeling at the through-door handle, the over-center handle mechanism further includes the spring to provide an opposing force against movement of the cam of the rotary actuator, and thus, the through-door handle. A solid lubricant of PTFE may also be provided as an interface between the cam and the spring to reduce friction therebetween.

19 Claims, 5 Drawing Sheets

OVER-CENTER HANDLE MECHANISM FOR INCREASED TACTILE FEEDBACK ON A ROTARY ACTUATOR

RELATED CASES

The present application claims priority under 35 U.S.C. §119(e) based on U.S. Provisional Application Ser. No. 61/935,544 filed on Feb. 4, 2014, which is incorporated by reference herein in its entirety.

FIELD

The present disclosure is related to an over center handle mechanism with a rotary actuator for operating electrical equipment housed in an electrical enclosure, and more particularly, to a spring assembly to adjust and control angular torque characteristic of the rotary actuator of an over-center handle mechanism.

BACKGROUND

There are many kinds of electrical equipment that, for safety considerations, are located inside an electrical enclosure and operated using a through-door handle with appropriate linkage to the equipment. For ergonomic reasons, electrical enclosures are often equipped with a large through-door handle to operate the electrical equipment, which can include for example a. circuit breaker(s), an electrical switch(es) or components that are part of a power distribution or protection system. Since the electrical equipment may not be originally designed specifically for operation with the through-door handle, the angular torque characteristics of the through-door handle may be poorly matched tier operating the electrical equipment that is housed in the electrical enclosure.

SUMMARY

An improved over-center handle mechanism is provided for operating electrical equipment, such as an electrical switch or circuit breaker, housed in an electrical enclosure using a through-door handle from outside of the electrical enclosure. For example, the over-center handle mechanism can include an adaptor knob, a rotary actuator and a through-door handle (e.g., an external handle on the exterior of an electrical enclosure). The adaptor knob interfaces with the electrical equipment. For example, the adaptor knob can include an aperture configured to slide over a circuit breaker or switch handle. The rotary actuator is connected to the adaptor knob and includes a cam. The through-door handle is used to operate the rotary actuator, which in turn operates the electrical equipment via the adaptor knob. To optimize an angular torque or snap "feeling" at the through-door handle, the over-center handle mechanism further includes a spring to provide an opposing force against movement of the cam of the rotary actuator, and thus, the through-door handle when operating the electrical equipment to different positions (e.g., OFF or ON position). A solid lubricant of PTFE can be provided as an interface between the cam and the spring to reduce friction therebetween. Accordingly, the over-center handle mechanism is able to provide for increased tactile feedback on the rotary actuator, and thus, the through-door handle. Furthermore, the over-center handle mechanism can be configured with a smaller form factor and minimized part count.

The spring operates as both a cantilever spring and a torsion spring at the same time. To function in this manner the spring has a generally U-shaped portion including two generally parallel legs that functions as torsion springs and two generally parallel arms extending generally perpendicularly from the two parallel legs of the torsion spring portion which function as a cantilever springs The torsion spring portion is confined at a point immediately adjacent to the point at which the cantilever spring portion begins such that the distance between the two generally parallel legs of the torsion spring portion can not increase. Each extending arm of the cantilever spring portion engages an outer surface of the cam and can have a PTFE sleeve to provide an interface between the cam and the spring. When the through-door handle is operated in either the clockwise or counter-clockwise direction to rotate the cam of the rotary actuator, the extending arms of the spring provide an opposing force against the outer cam surface of the rotating cam. The cam can have a substantially quadrilateral cross-section (e.g., rectangular, parallelogram, etc.), with the two extending arms of the spring positioned adjacent to and in contact with opposite sides of the cam. The cross-sectional shape of the cam can be configured to provide a desired torque profile when operating the through-door handle between different positions, such as between ON and OFF positions for the electrical equipment. For example, by configuring the shape of the cam and the placement of the spring, it is possible to provide two different torque or snap "feelings" for two different operations, e.g., when turning the electrical equipment from the OFF to ON position or from the ON to OFF position. Thus, the typical over-center feel of operation for an electrical switch may be maintained by appropriate selection of the cam faces. To provide for different angular torque profiles, the cam can be configured with an asymmetrical cross-sectional shape or area. Instead of a cantilever spring, a torsion spring can also be designed with two deflectable extending arms for use with the over-center handle mechanism.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

Figure 1:
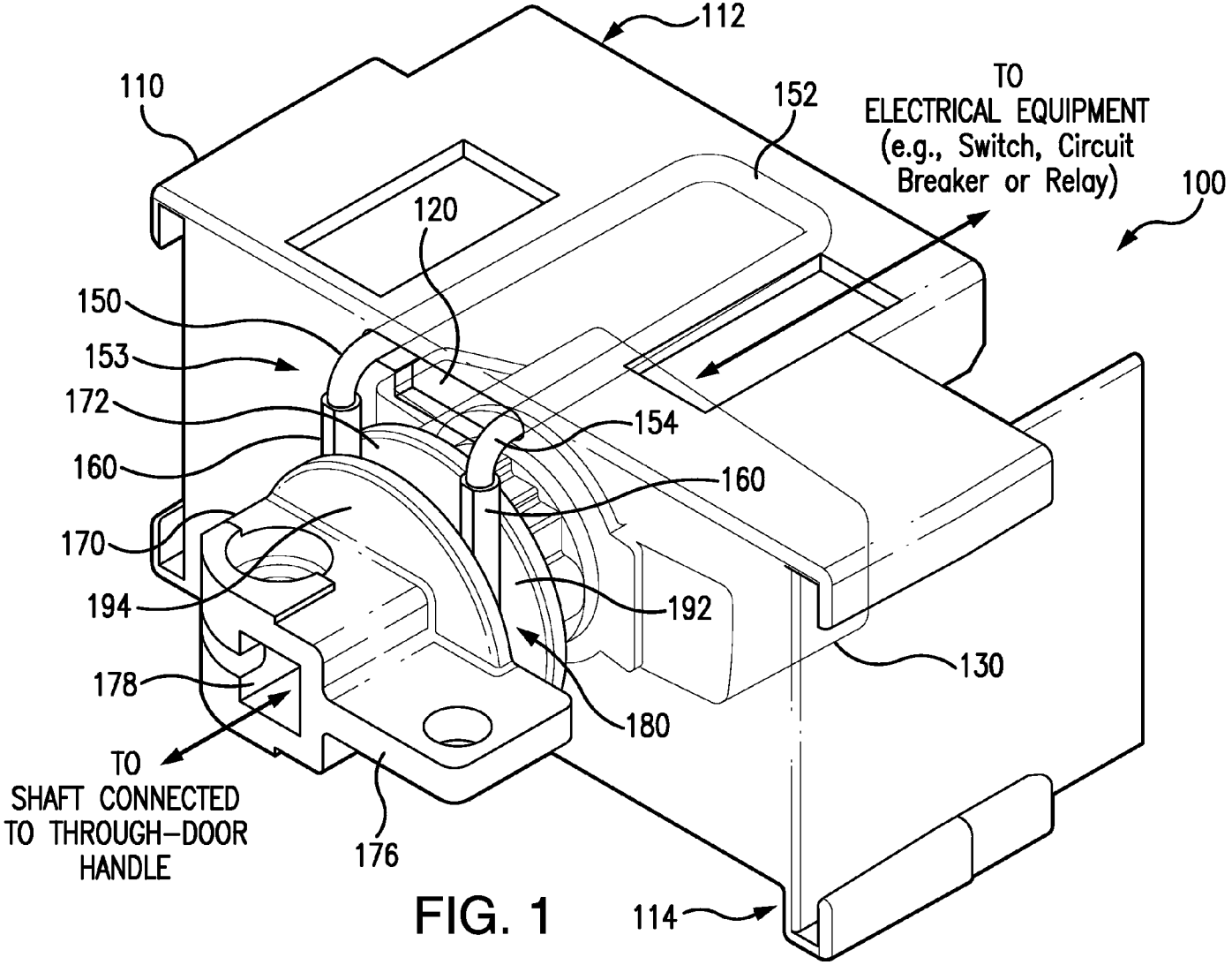
FIG. 1 illustrates a perspective view of an over-center handle mechanism for operating electrical equipment housed inside of an electrical enclosure, the mechanism including an adaptor knob to interface with the electrical equipment, a rotary actuator, a spring, and a housing (currently phantomed), in accordance with an exemplary embodiment of the present disclosure.

The present disclosure describes an over-center handle mechanism 100 for operating electrical equipment (e.g., an electrical switch, a circuit breaker or relay) housed in an electrical enclosure. The over-center handle mechanism 100 includes an adaptor knob 130 to interface with the electrical equipment, a rotary actuator 170 connected to the adaptor knob 130, and a spring 150. A through-door handle, which is outside of the enclosure, is operatively connected to the rotary actuator 170 to operate the electrical equipment, via the rotary actuator 170 and the adaptor knob 130. The spring 150 is arranged to apply an opposing force (e.g., a spring force) against an outer cam surface of a cam 300 on the rotary actuator 170 to adjust and control an angular torque characteristic of the rotary actuator 170, and thus, the through-door handle connected thereto. An example of the over-center handle mechanism 100 is described in greater detail below with reference to the figures.

Figure 2:
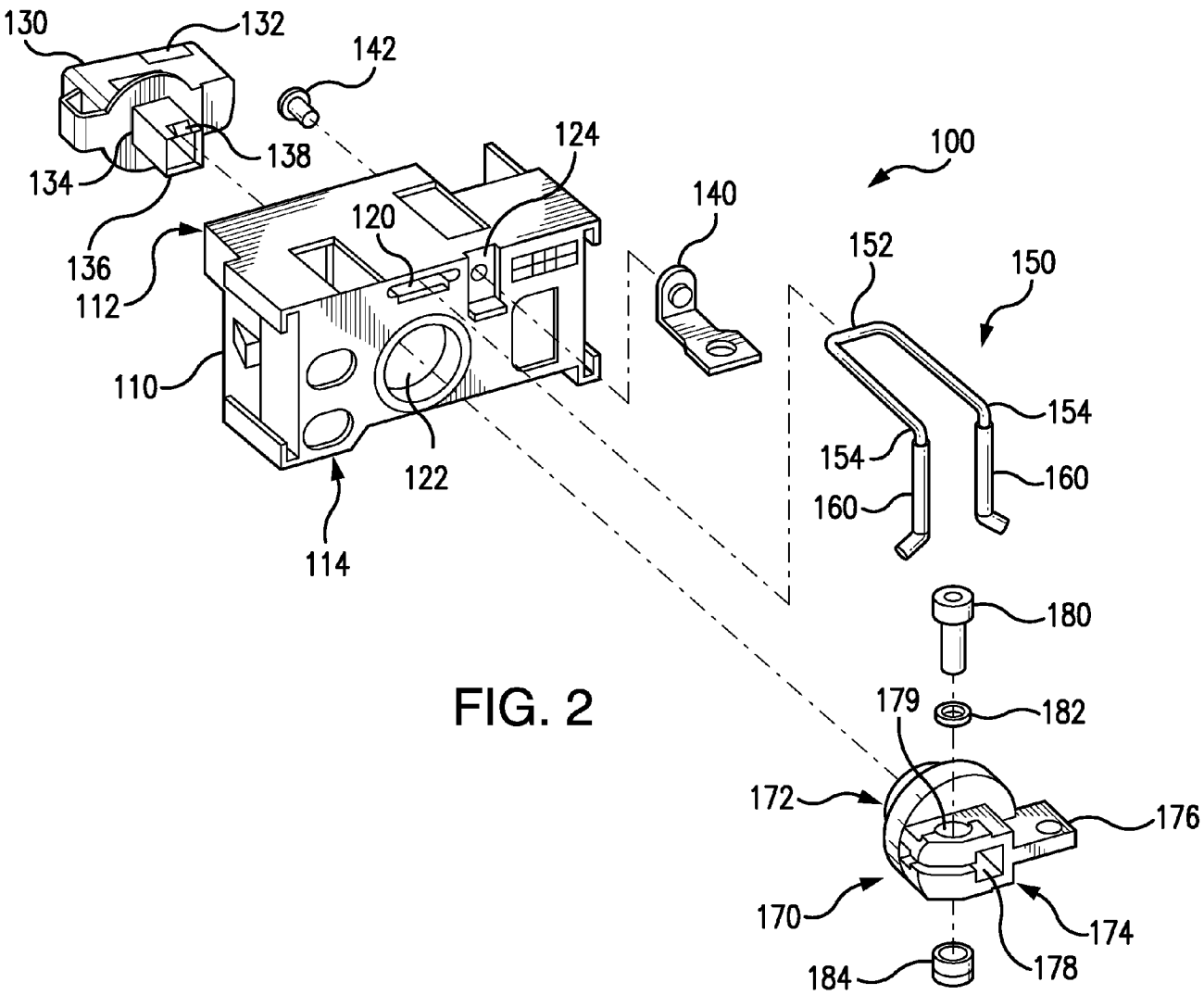
FIG. 2 illustrates an exploded view of the components of the over-center handle mechanism of FIG. 1.

FIG. 1 illustrates an over-center handle mechanism 100 for operating electrical equipment housed in an electrical enclosure. FIG. 2 illustrates an exploded view of the components of the over-center handle mechanism 100. As shown in FIGS. 1 and 2, the over-center handle mechanism 100 includes an adaptor knob 130, a spring 150 and a rotary actuator 170, which are assembled onto a housing 110. The over-center handle mechanism 100 can also include a through-door handle (e.g., an external handle on the exterior of an electrical enclosure). The through-door handle is used to operate the rotary actuator 170, which in turn operates the electrical equipment via the adaptor knob 130.

The housing 110 includes a first side 112 and an opposite second side 114, with a through-hole 122 extending therebetween. The adaptor knob 130 is positioned on the first side 112, and the rotary actuator 170 is positioned on the second side 114. The housing 110 includes a spring slot 120 to receive and mount a portion of the spring 150 onto the housing relative to the rotary actuator 170. The spring slot 120 extends through the second side 114 of the housing 110 over and proximate to the through-hole 122. The housing 110 is mountable inside of an electrical enclosure.

The adaptor knob 130 interfaces with the electrical equipment, such as, for example, an electrical switch, a circuit breaker or relay, which is housed in an electrical enclosure. The adaptor knob 130 can include a first side 132 and a second side 134. The adaptor knob 130 is configured on the first side 132 to interact, directly or indirectly, with the electrical equipment. For example, the adaptor knob 130 can include an aperture, which is configured to slide over an operating handle of the electrical equipment, on the first side 132. The adaptor knob 130 includes an adaptor knob shaft 136 extending generally perpendicularly from the second side 134 along the rotational axis of the adaptor knob 130. In this example, the adaptor knob shaft 136 has a rectangular cross-section. The adaptor knob shaft 136 includes one or more latches 138 (e.g., latching ears) at its distal end for connecting the adaptor knob 130 to the rotary actuator 170, when the adaptor knob shaft 136 is inserted into a socket 320 of the rotary actuator 170.

The rotary actuator 170 includes a first end 172 and an opposite second end 174. The rotary actuator 170 is connected on the first end 172 to the adaptor knob 130, via the through-hole 122 of the housing 110. The rotary actuator 170 also includes a shaft opening 178 on the second end 174 to receive a shaft or other linkage assembly (not shown), which is operatively connected to the through-door handle. The rotary operator 170 can include a bolt hole 179 through which to receive a bolt assembly to secure the shaft in the shaft opening 178 of the rotary actuator 170. The bolt assembly can include a bolt 180, washer 182 and a nut 184.

The rotary actuator 170 further includes a first disc-shaped wall 192 on the first end 172 and an opposite second disc-shaped wall 194 on the second end 174. The first wall 192 and the second wall 194 are spaced apart, and arranged substantially perpendicular to a rotational axis of the rotary actuator, when rotatably mounted to the housing 110.

Figure 3:
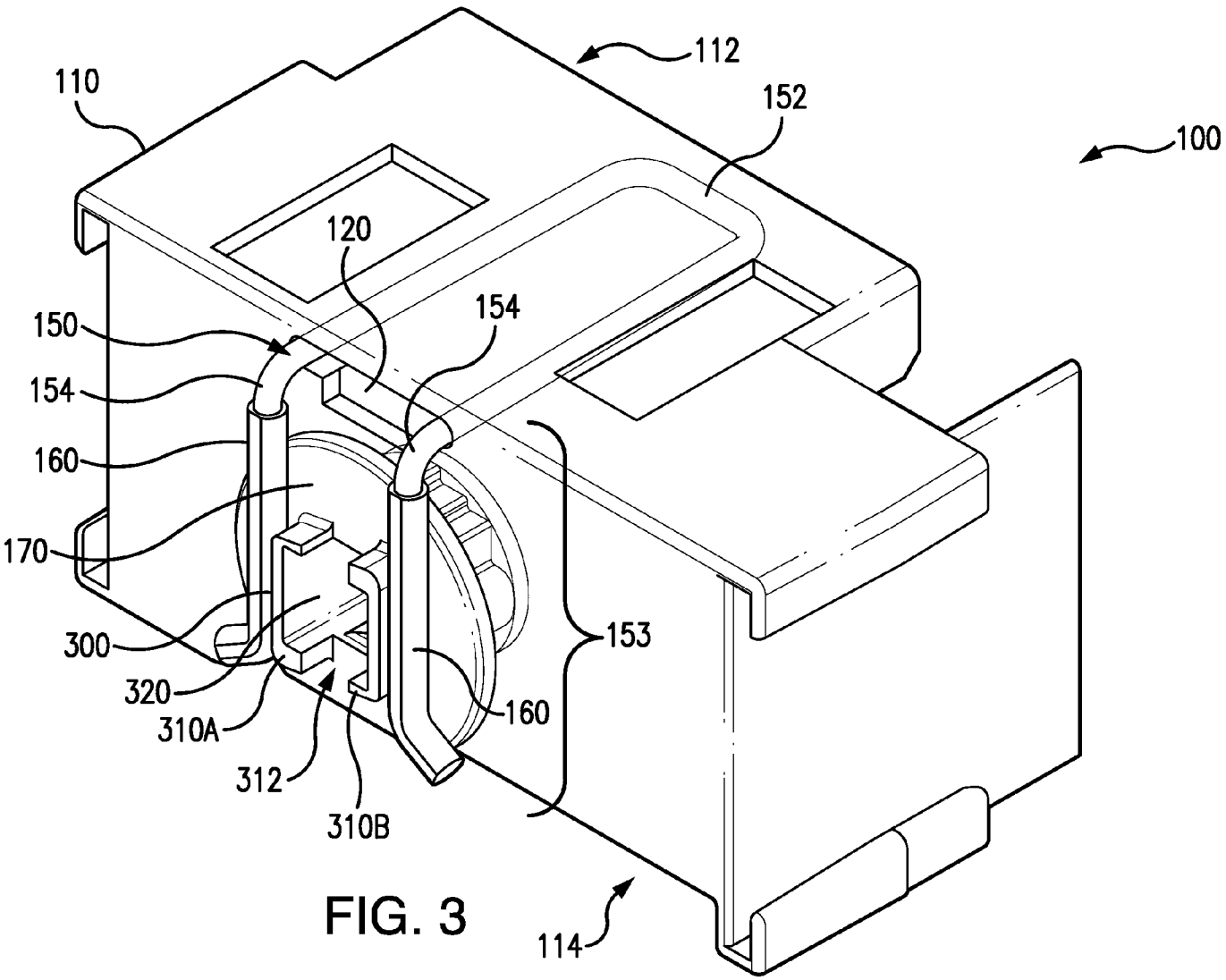
FIG. 3 illustrates a cut-away view of the rotary actuator of the over-center handle mechanism of FIG. 1 with the housing (currently phantomed), particularly showing the arrangement between the spring and an outer cam surface of a cam of the rotary actuator in order to adjust an angular torque profile of the over-center handle mechanism.

As further shown in FIG. 3, the rotary actuator 170 also includes a cam 300, which extends along the rotational axis and forms a bridge to connect the first wall 192 to the second wall 194. The socket 320 extends from the first end 172 of the rotary actuator 170 through the cam 300, and is configured to receive the shaft 136 of the adaptor knob 130 (see e.g., in FIG. 2). The socket 320 and surrounding cam 300 can have an asymmetrical cross-sectional shape to provide and control an over-travel range between the adaptor knob 130 and the rotary actuator 170, and thus, the through-door handle connected thereto. Thus, the dimension of the cam 300, socket 320 and the cross-sectional shape of the adaptor knob shaft 136 can be configurable to control an over-travel range in a clockwise or counter-clockwise direction for the rotary actuator 170.

In FIG. 3, the cam 300 has a substantially quadrilateral cross-sectional shape. The cam 300 includes a first U-shaped cam portion 310A and a second U-shaped cam portion 310B, which are spaced apart to form two opposing latch slots 312 in the cam 300. Each of the latch slots 312 are configured to receive a respective latch 138, as shown in FIG. 2, when the adaptor knob shaft 136 of the adaptor knob 130 is fully engaged in the socket 320 of the rotary actuator 170, to securely connect the adaptor knob 130 and the rotary actuator 170 together.

To adjust and control an angular torque characteristic (e.g., angular torque profile), the over-center handle mechanism 100 employs the spring 150, as shown in FIG. 3, which has a portion mounted and supported in the spring slot 120 of the housing 110. The spring 150 is used to apply force against the cam surfaces to oppose movement (e.g., rotation) of the rotary actuator 170, and thus, of the other connected components such as the adaptor knob 130 and the through-door handle during operation. The spring 150 has one or more deflectable portions that are positioned adjacent to and in contact with the outer cam surface of the cam 300, to apply a spring force against the outer cam surface. Thus, it is possible to optimize an angular torque feeling at the through-door handle, by way of the interaction between the spring 150 and the cam 300 of the rotary actuator 170.

Figure 4:
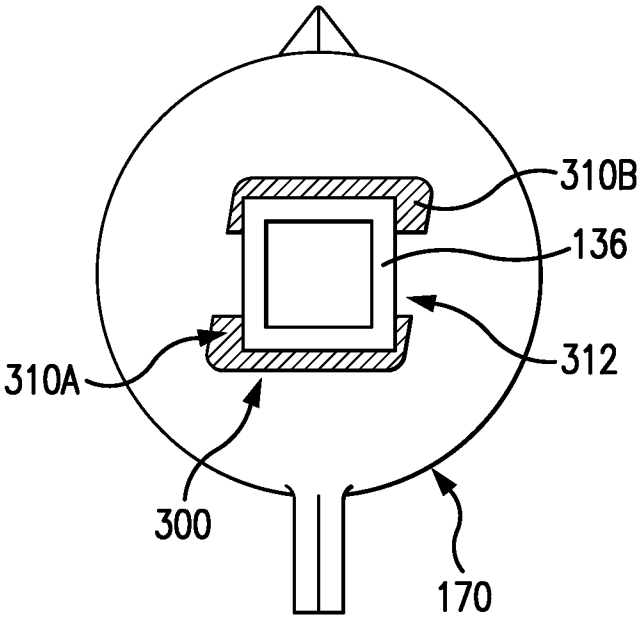
FIG. 4 illustrates a cross-sectional view of the rotary actuator for the over-center handle mechanism in FIG. 1, with a cam of the rotary actuator having a cross-sectional shape in the form of a parallelogram, in accordance with another embodiment of the present disclosure.

As shown in FIG. 3, the cam 300 can have a substantially symmetrical cross-sectional shape, in the form of a rectangle, which provides for the same torque profile when operating the rotary actuator 170, and thus the through-door handle, in a clockwise direction (e.g., from an OFF to ON position) or a counter-clockwise direction (e.g., from an ON to OFF position). The cam 300, however, can be designed with an asymmetrical cross-sectional shape to provide different angular torque profiles when operating the rotary actuator in a clockwise direction versus counter-clockwise direction. Another example of the cam 300 of the rotary actuator 170 is shown in FIG. 4, with a cross-sectional shape in the form of a parallelogram instead of a rectangle.

Figure 5:
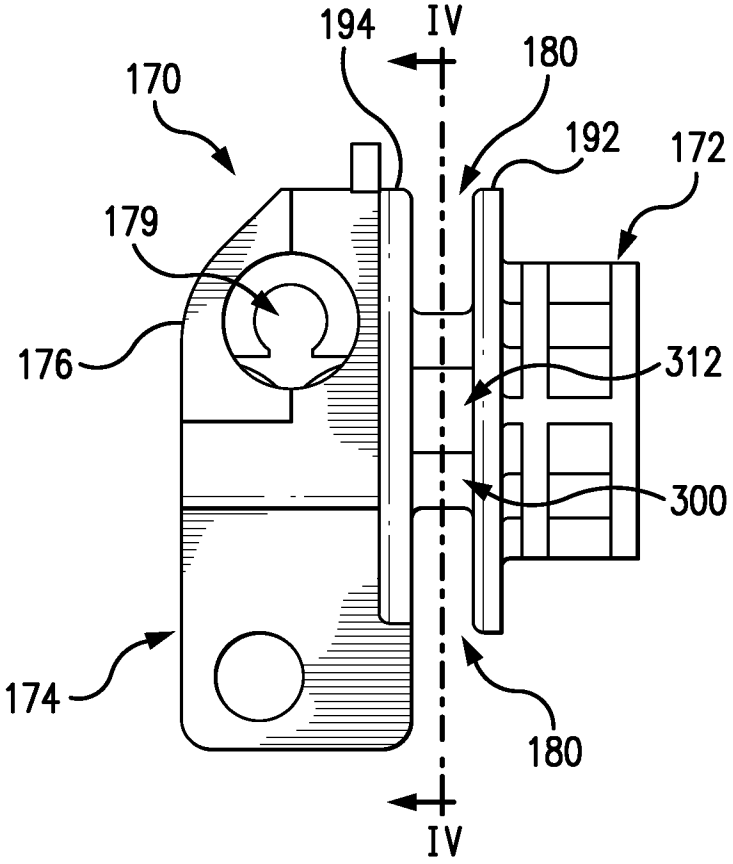
FIG. 5 illustrates a side view of a rotary actuator for the over-center handle mechanism in FIG. 1.

FIG. 5 illustrates a side view of the rotary actuator 170, which includes the first end 172 and the second end 174. The cam 300 is shown as being connected between the first and second walls 192 and 194, and includes the latch slot 312. A space 180 for receiving the extending arms 154 of spring 150 is also shown between the first and second walls 192 and 194.

Figure 8:
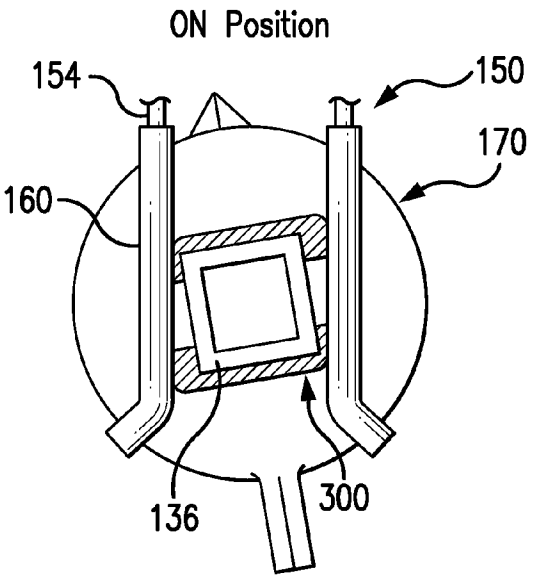
FIG. 8 illustrates a cross sectional view of the cam of the rotary actuator in FIG. 4 in relation to the spring of the over-center handle mechanism of FIG. 1, when the actuator is rotatably adjusted to the ON position.
Figure 7:
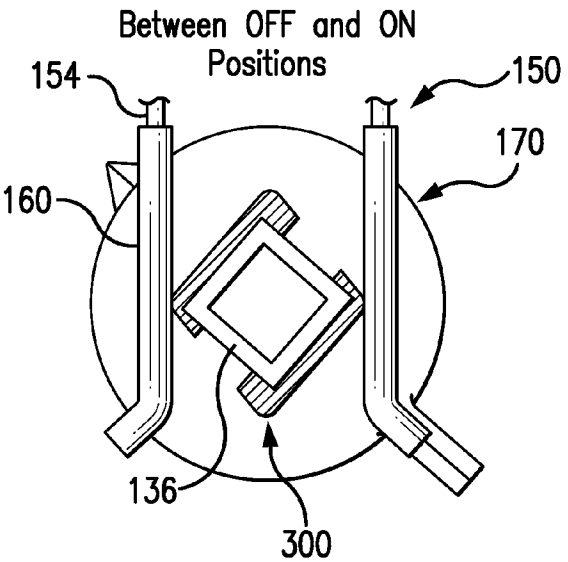
FIG. 7 illustrates a cross sectional view of the cam of the rotary actuator in FIG. 4 in relation to the spring of the over-center handle mechanism of FIG. 1, when the actuator is rotatably adjusted between the OFF and ON positions.
Figure 6:
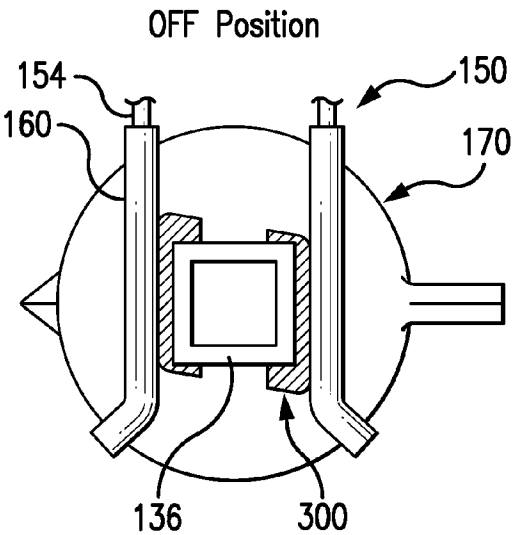
FIG. 6 illustrates a cross sectional view of the cam of the rotary actuator in FIG. 4 in relation to the spring of the over-center handle mechanism of FIG. 1, when the actuator is rotatably adjusted to the OFF position.

FIGS. 6-8 illustrate the relationship of the extending arms 154 of the spring 150 and the outer surface of the cam 300 (e.g., the cam 300 in in FIG. 4), during operation of the through-door handle, and thus, the rotary actuator 170 between an OFF position and an ON position. The adaptor knob shaft 136 is engaged in the rotary actuator 170 (e.g., in the socket 320 of FIG. 3). For example, in FIG. 6, the rotary actuator 170 is shown in the OFF position, with the extending arms 154 in a substantially non-deflected state. At this position, the extending arms 154 can apply little or no spring force against the outer surface of the cam 300. FIG. 7 shows that the rotary actuator 170 is between the OFF and ON position, with the extending arms 154 in a substantial deflected state and applying substantial spring force against the outer surface of the cam 300. In FIG. 8, the rotary actuator 170 is shown in the ON position, with the extending arms 154 in a substantially non-deflected state. As previously discussed, the cross-sectional shape of the cam 300 can be designed to control the torque profile to provide the same or different angular torque feeling when operating the through-door handle or the rotary actuator 170 to different positions, such as an ON position or an OFF position for the electrical equipment.

The over-center handle mechanism 100, as described herein, is provided as an example. The cam 300 of the rotary actuator 170 can be configured with other types of cross-sectional shapes, such as other polygon shapes, which are symmetrical or asymmetrical. Furthermore, the housing 110 can be configured in any suitable shape and dimension to mount the adaptor knob 130, the spring 150 and the rotary actuator 170. For example, the housing 110 can simply be a plate with a through-hole 122 and a spring slot 120.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. An over-center handle mechanism to operate electrical equipment housed in an electrical enclosure, the over-center handle mechanism comprising:

an adaptor knob to interface with the electrical equipment;

a rotary actuator connected to the adaptor knob and including a cam having an outer cam surface, the rotary actuator being further connectable to a through-door handle for operating the electrical equipment via the rotary actuator from outside of the electrical enclosure; and a spring, positioned adjacent to the outer cam surface of the cam, to provide an opposing force against rotation of the cam of the rotary actuator.

2. The over-center handle mechanism of claim 1, wherein the spring includes a deflectable extending arm to apply a spring force on the outer cam surface of the cam of the rotary actuator.

3. The over-center handle mechanism of claim 2, wherein the spring includes two deflectable extending arms which are substantially parallel to each other, the cam being arranged between the two deflectable extending arms.

4. The over-center handle mechanism of claim 3, wherein each deflectable extending arm has a PTFE sleeve to interface with the outer cam surface of the cam.

5. The over-center handle mechanism of claim 3, wherein the cam has a substantially quadrilateral cross-section, which is arranged between the two deflectable extending arms of the spring.

6. The over-center handle mechanism of claim 2, further comprising:

an adaptor knob shaft to connect the adaptor knob to the rotary actuator; and a housing mountable in the electrical enclosure, the housing having a first side and an opposing second side, the adaptor knob being arranged on the first side of the housing, the rotary actuator being arranged on the second side of the housing, the adaptor knob shaft extending through a through-hole in the housing to connect the adaptor knob to the rotary actuator.

7. The over-center handle mechanism of claim 6, wherein the spring has a closed end, and a free end with two deflectable extending arms, the closed end being supported on the second side of the housing.

8. The over-center handle mechanism of claim 7, wherein the closed end of the spring is bent at an angle relative to the free end, and the second side of the housing includes a spring slot to receive the closed end of the spring.

9. The over-center handle mechanism of claim 6, wherein the housing comprises a plate.

10. The over-center handle mechanism of claim 3, wherein the rotary actuator further includes:

a first end having a first wall; and a second end opposite the first end, the second end having a second wall spaced apart from the first wall, the cam forming a bridge between the first wall and the second wall, the two deflectable extending arms arranged in a space between the first and second walls and arranged to apply a spring force against the outer cam surface from opposite sides of the cam.

11. The over-center handle mechanism of claim 1, wherein the spring adjusts an angular torque characteristic of the rotary actuator when operating the electrical equipment.

12. The over-center handle mechanism of claim 11, wherein the electrical equipment comprises an electrical switch, a circuit breaker or relay.

13. The over-center handle mechanism of claim 1, further comprising an adaptor knob shaft to connect the adaptor knob to the rotary actuator, wherein the rotary actuator further includes a socket to receive the adaptor knob shaft.

14. The over-center handle mechanism of claim 13, wherein the knob connector shaft includes a latch, and the cam includes a latch slot to receive the latch when the adaptor knob shaft is engaged in the socket of the rotary actuator.

15. The over-center handle mechanism of claim 14, wherein the adaptor knob shaft includes a pair of the latches, and the cam comprises two spaced apart U-shaped cam portions which form two latch slots therebetween to receive a respective latch from the pair of the latches.

16. The over-center handle mechanism of claim 13, wherein the cam has an asymmetrical cross-sectional shape to provide different angular torque profiles when operating the rotary actuator in a clockwise direction versus counter-clockwise direction.

17. The over-center handle mechanism of claim 13, wherein the dimension of the socket is configured to control an over-travel range in a clockwise or counter-clockwise direction for the rotary actuator.

18. The over-center handle mechanism of claim 1, wherein the rotary actuator further includes a shaft adaptor to provide for connection to the through-door handle.

19. The over-center handle mechanism of claim 1, further comprising the through-door handle.

* * * * *